US005109551A

United States Patent [19]

Lecat

[11] Patent Number: 5,109,551

[45] Date of Patent: May 5, 1992

[54] TOILET BOWLS WITH THE AIM OF ECONOMIZING WATER AND ELECTRIC ENERGY

[75] Inventor: Roger J. Lecat, Paris, France

[73] Assignee: Societe Civile Particuliere Fact-Anal, Savigny en Sancerre, France

[21] Appl. No.: 453,911

[22] Filed: Dec. 20, 1989

[30] Foreign Application Priority Data

Jan. 11, 1989 [FR] France ..... 89 00254

[51] Int. Cl.[5] ..... E03D 11/02

[52] U.S. Cl. ..... 4/431; 4/420

[58] Field of Search ..... 4/431-433

[56] References Cited

U.S. PATENT DOCUMENTS

| | | | |
|---|---|---|---|
| 1,329,932 | 2/1920 | Sell et al. | 4/432 |
| 2,724,837 | 11/1955 | McPherson . | |
| 3,035,274 | 5/1962 | Baughman | 4/432 |
| 3,157,888 | 11/1963 | Violette . | |
| 3,323,650 | 6/1967 | Kilbane | 4/431 X |
| 3,431,563 | 3/1969 | Rascov | 4/432 X |
| 3,699,592 | 10/1972 | Minchak | 4/431 X |

FOREIGN PATENT DOCUMENTS

| | | |
|---|---|---|
| 101387 | 2/1984 | European Pat. Off. . |
| 2200903 | 4/1974 | France . |
| 2241664 | 3/1975 | France . |

OTHER PUBLICATIONS

Copy of the French Search Report.

*Primary Examiner*—Charles E. Phillips

*Attorney, Agent, or Firm*—Sandler, Greenblum & Bernstein

[57] ABSTRACT

Toilet bowl having a suction-extractor wherein the suction-extractor is driven rotationally by a hydraulic turbine activated by pressurized water of the distribution system. A pipe is associated with the body of the hydraulic turbine for flow of water from the turbine to rinse the bowl.

10 Claims, 2 Drawing Sheets

TOILET BOWLS WITH THE AIM OF ECONOMIZING WATER AND ELECTRIC ENERGY

The present invention relates to improvements to toilet bowls of the suction-extractor type, characterized by the fact that they use only the sole and unique energy of household hydraulic pressure.

There are already known bowls whose outlet orifice communicates with a chamber enclosing an electromechanical rotary means which generally fills the function of suctioning the contents of the bowl after usage and to reverse it into a conduit for evacuation connected to the main sewer.

The electric drive motor is generally placed in the base of the bowl in a location which is not very accessible and always wet.

Moreover, the electric motor requires a significant consumption of energy.

The present invention, which overcomes these disadvantages, is remarkable in that there is used a suction-extractor driven rotationally by the (interposition) of a hydraulic turbine activated by pressurized water of the distribution system.

According to another characteristic of the invention, the water which comes from the turbine is used for rinsing of the bowl, which permits a significant saving in water.

The invention will be better understood by the description which follows, done with reference to the annexed drawings by way of indicative example, in which.

Figure 1:
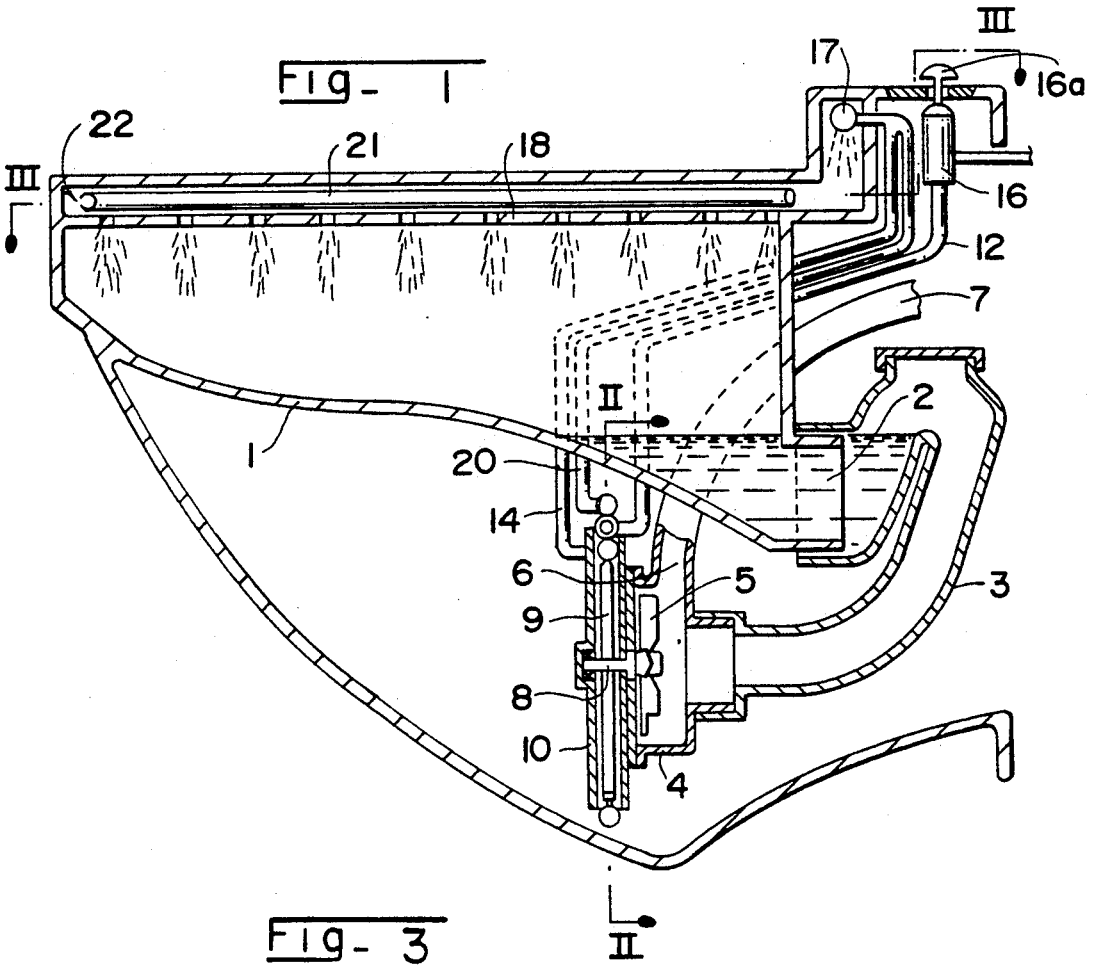
FIG. 1 is a vertical sectional view of a bowl conforming to the invention.
Figure 3:
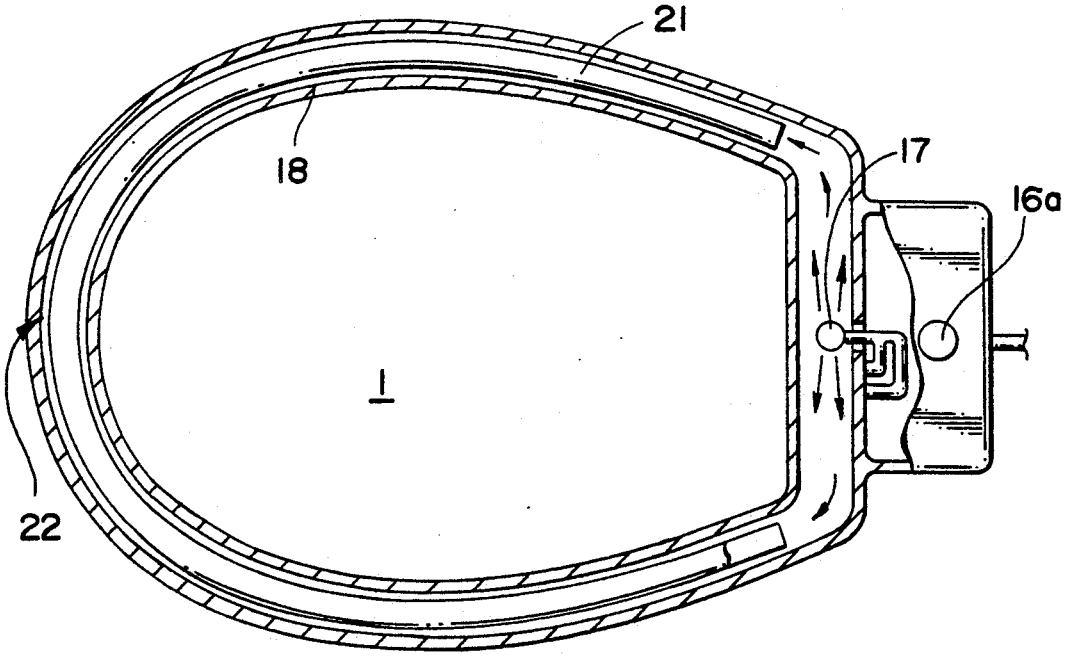
FIG. 3 is a sectional view along broken line III—III of FIG. 1.

By referring to the drawings, it can be seen that 1 is a conventional bowl, as described in the FR pat. No. 82,14160 published under the No. U.S. Pat. No.2,531,735.

The outlet orifice 2 of the bowl communicates through a pipe 3 with the body 4 of the suction-extractor 5, said body having a reversing orifice 6 connected to the main sewer by a conduit 7.

According to the invention, the shaft 8 of the suction-extractor is driven rotationally by a hydraulic turbine 9 lodged in a body 10.

Turbine 9 is activated by pressurized water of the distribution system.

Figure 2:
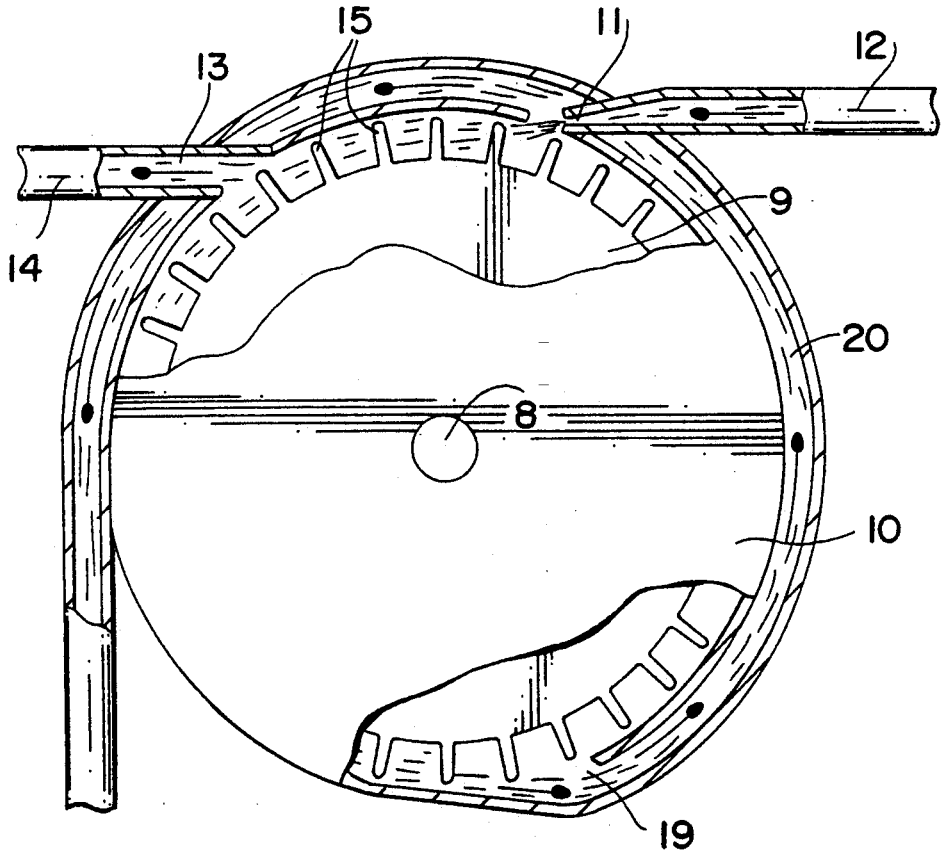
FIG. 2 is a partial and enlarged view along line II—II of FIG. 1.

As is clear from FIG. 2, the pressurized water enters body 10 through the hammered opening 11 of a pipe 12 and emerges through an orifice 13 of greater diameter, connected to an evacuation pipe 14.

Orifices 11 and 13 are positioned such that the jet strikes the blades 15, substantially perpendicular to the latter, and such that the path of the pressurized jet of water in the body 10 is as reduced as possible and curved only a small amount (FIG. 2).

The pipe 12 is fed by pressurized water of the distribution system by the interposition of a "tap" 16 which can be either a tap of the conventional type, whose opening is controlled by a pusher, comprising a time-delayed, pneumatic closing device or a manually controlled electrovalve.

According to another characteristic of the invention, the outlet pipe 14 is connected to the head 17 for feeding the punched ramp 18, usual, for distribution of water for rinsing of the bowl.

In this manner, the same quantity of water is used both to activate the device schematized by the suction-extractor 5 and to carry out the rinsing of the bowl.

The functioning of the device is the following: when the user pushes on the pusher **16*a* of the delayed closing tap 16, the pressurized water reaches the orifice 11 and drives the turbine, which has the effect of suctioning the contents of the bowl and reversing through pipe 7** whose diameter is on the order of 30–50 mm.

Simultaneously, the water which comes from the body of the turbine reaches the ramp 18, through the pipe 14 and carries out the rinsing of the bowl.

When the circuit for input of pressurized water is cut, the turbine, whose mass is significant, continues to turn but it slows down and the suctioning decreases then ceases.

To re-establish the level of water in the bowl, to that of the original, stored water is used during the rinsing in a tube 21, lodged in the ramp 18, and open at its two ends. The tube 21 has, substantially in the middle of its length, an orifice for aeration 22 favoring rapid filling and emptying. This is why, when the head 17 is no longer fed with water, the tube 21 empties and re-establishes the retention of water in the bowl. At this time, the cycle is terminated and the bowl is ready for a new usage.

To further the starting of the turbine, it is important that the hydraulic friction be reduced and, for that purpose, it is fitting that at the end of the cycle, the body of the turbine no longer comprise water.

To that end, the body 10 has, on its lower part an orifice 19 connected, by a pipe 20, to that of 14, near the head 17 so as not to brake its indispensable free flow, if not, there results a slowing contrary to the end sought.

As a result, towards the end of the cycle and when the feeding with water is cut, the water which still remains in the body 10 is reversed towards the pipe 20 by the rotation of the turbine which continues to turn under the effect of kinematic energy.

Of course, the present invention is not limited to the embodiment described and shown but on the contrary, extends to any alternatives of forms and dimensions and usage other than sanitary.

I claim:

1. A toilet bowl which utilizes water comprising:

a bowl;

suction-extractor including a hydraulic turbine;

means for rinsing said bowl including a ramp and a tube open at its two ends positioned in the ramp, with the tube having an orifice for aeration;

means forming a water distribution system for providing water to said means for rinsing said bowl and to said hydraulic turbine of said suction-extractor; and said means forming a water distribution system providing for flow of water from said hydraulic turbine to said means for rinsing.

2. The toilet bowl according to claim 1, wherein said orifice is positioned substantially in the middle of the length of the tube.

3. The tolet bowl according to claim 1, wherein said hydraulic turbine is located within a body.

4. The toilet bowl according to claim 3, wherein said means forming a water distribution system include an inlet pipe having a hammered inlet and an outlet, said hydraulic turbine includes blades, and said hammered inlet is positioned to permit water exiting therefrom to strike the blades substantially perpendicularly thereto.

5. The toilet bowl according to claim 4, wherein said body further includes a pipe connected to a lower portion thereof and extending above said body.

6. A toilet bowl which utilizes water comprising:

a bowl;

suction-extractor including a hydraulic turbine;

means for rinsing said bowl including a ramp and a tube open at its two ends positioned in the ramp, with the tube having an orifice for aeration;

means forming a water distribution system for providing water to said means for rinsing said bowl and to said hydraulic turbine of said suction-extractor;

said means forming a water distribution system providing for flow of water from said hydraulic turbine to said means for rinsing: and said hydraulic turbine including means for permitting the water contained in the hydraulic turbine to drain therefrom.

7. The toilet bowl according to claim 6, wherein said hydraulic turbine is located within a body.

8. The toilet bowl according to claim 7, wherein said means forming a water distribution system include an inlet pipe having a hammered inlet and an outlet, said hydraulic turbine includes blades, and said hammered inlet is positioned to permit water exiting therefrom to strike the blades substantially perpendicularly thereto.

9. The toilet bowl according to claim 6, wherein said means permitting draining includes a pipe connected to a lower portion thereof and extending above said body.

10. The toilet bowl according to claim 6, wherein said orifice is positioned substantially in the middle of the length of the tube.

* * * * *